US007543682B2

(12) United States Patent
Hanitzsch et al.

(10) Patent No.: US 7,543,682 B2
(45) Date of Patent: Jun. 9, 2009

(54) SHEET-METAL-TYPE PART

(75) Inventors: Robert Hanitzsch, Kernen (DE); Thomas Werber, Esslingen (DE); Arnulf Spieth, Hochdorf (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 11/805,431

(22) Filed: May 23, 2007

(65) Prior Publication Data

US 2008/0121460 A1 May 29, 2008

(30) Foreign Application Priority Data

May 23, 2006 (DE) ..... 10 2006 024 576

(51) Int. Cl.
*F01N 7/08* (2006.01)
*F01N 1/02* (2006.01)

(52) U.S. Cl. ..... 181/228; 181/227; 181/249; 180/309

(58) Field of Classification Search ..... 181/228, 181/227, 249; 180/309
See application file for complete search history.

(56) References Cited

U.S. PATENT DOCUMENTS

| | | | | |
|---|---|---|---|---|
| 3,482,649 | A * | 12/1969 | Murphy | 181/240 |
| 4,487,289 | A * | 12/1984 | Kicinski et al. | 181/252 |
| 4,530,418 | A * | 7/1985 | Currie | 181/227 |
| 5,147,987 | A * | 9/1992 | Richardson et al. | 181/264 |
| 5,824,970 | A * | 10/1998 | Gracia | 181/228 |
| 6,220,387 | B1 * | 4/2001 | Hoppes et al. | 181/259 |
| 6,827,173 | B2 * | 12/2004 | Lai | 180/309 |
| 7,152,710 | B1 * | 12/2006 | Huang et al. | 181/227 |
| 7,316,109 | B2 * | 1/2008 | Clerc et al. | 60/311 |
| 2001/0015301 | A1 * | 8/2001 | Kesselring | 181/249 |
| 2002/0027041 | A1 * | 3/2002 | Czabala et al. | 181/229 |
| 2006/0151238 | A1 * | 7/2006 | Giordano | 181/227 |

FOREIGN PATENT DOCUMENTS

| | | | |
|---|---|---|---|
| DE | 3514475 | A1 | 10/1986 |
| DE | 9409952.9 | | 6/1994 |
| EP | 0828064 | A3 | 12/1998 |
| EP | 1183446 | B1 | 11/2005 |
| WO | 95/35435 | A1 | 12/1995 |

OTHER PUBLICATIONS

German Search Report dated May 15, 2007.
European Search Report dated Aug. 29, 2007.
European Examination Report dated Jul. 18, 2008.

* cited by examiner

*Primary Examiner*—Jeffrey Donels
*Assistant Examiner*—Christina Russell
(74) *Attorney, Agent, or Firm*—Howard IP Law Group, PC

(57) ABSTRACT

The present invention relates to a sheet-metal-type part, in particular a muffler bottom having at least one through-opening for a tubular part. The sheet-metal-type part has at least one slot passing through the sheet-metal-type part in an area adjacent to the through-opening. The slot runs essentially in the circumferential direction or runs tangentially to the through-opening.

16 Claims, 1 Drawing Sheet

SHEET-METAL-TYPE PART

This application claims foreign priority of German Patent Application No. DE 10 2006 024 576.8, filed May 23, 2006 in Germany, which application is incorporated herein by reference in its entirety.

FIELD OF THE INVENTION

The present invention relates to a sheet-metal-type part, in particular a muffler bottom having at least one through-opening for a tubular part, in particular for an exhaust pipe.

BACKGROUND OF THE INVENTION

In a multitude of applications, it is necessary to pass a tubular part through a through-opening in a sheet-metal-type part and connect it there. Such an application would be, for example, a muffler bottom of an exhaust system for an internal combustion engine, (for example, in a motor vehicle) through which bottom, an exhaust pipe passes. During operation of the exhaust system, there may be mechanical stress in the area of the connection of the tubular part to the sheet-metal-type part, and the resulting force peaks may result in cracking in the circumferential edge of the through-opening.

SUMMARY OF THE INVENTION

The present invention relates to the problem of providing an embodiment for a sheet-metal-type part of the generic type so that it will be characterized by a better durability in particular.

The present invention is based on the general idea of providing at least one slot that passes through the sheet-metal-type part in an area adjacent to the through-opening, so that the slot runs in the circumferential direction of the through-opening or tangentially thereto. One or more such slots result in an improved introduction of force into the sheet-metal-type part during operation of the exhaust system and/or in heating of the tubular part and thus lead to a force flow running in a meandering line around the slots provided in the sheet-metal-type part. Owing to the meandering line of the force flow, the force is introduced into the sheet-metal-type part along a much longer path, so it is capable of absorbing the force introduced in the elastic range and thus absorbing it without deformation and/or damage. Due to the elimination of stress peaks that exceed the elastic range of the sheet-metal-type part, the lifetime of the arrangement of parts formed by the tubular part and the sheet-metal-type part can be increased significantly.

Essentially the at least one slot passing through the sheet-metal-type part can be produced by a suitable cutting operation with or without removal of material. In an exemplary embodiment, the respective slot is produced by punching out and/or punching through an area of the sheet-metal-type part which is in the area adjacent to the through-opening, e.g., by means of a corresponding punching operation. Such a punching operation can be implemented as a non-cutting operation, so the tool used in this process can achieve a long lifetime and the manufacturing cost for the sheet-metal-type part can therefore be reduced.

The slot expediently has a rounded end which enlarges the width of the slot at one end, or the end sections of the slot on the longitudinal end may be curved in a semicircular shape. Both variants produce a favorable flow of force in the area of the slot at the longitudinal end and thereby reduce the risk of cracking of the end of the slot. Due to the embodiment of the areas of the slots at the longitudinal end described here, stress peaks can thus be absorbed better and at the same time the lifetime of the sheet-metal-type part can be increased.

In another exemplary embodiment of the inventive approach, at least two slots have different lengths. The longitudinal extent of slots may be adapted individually to the force flow that occurs and/or is expected to occur, so that at the time of its manufacture, the sheet-metal-type part can be aligned especially well with the stresses occurring in the later operating state.

In yet another exemplary embodiment of the inventive approach, several slots are arranged along several circles spaced a distance apart radially. These circles need not necessarily have the same midpoint and they produce a favorable force flow of the force to be introduced in particular with an arrangement of the slots along the circles, which is selected in the manner of an offset arrangement. Due to the slots arranged in the manner of an offset arrangement, the force flow is forced to follow a meandering line, thereby lengthening the distance traveled. This prolonged force introduction pathway causes the material to be capable of absorbing the force introduced in the elastic range, so there is no plastic deformation, in particular no prominent plastic deformation during operation.

It is self-evident that the features mentioned above and those yet to be explained below may be used not only in the particular combination given but also in other combinations or alone without going beyond the scope of the present invention.

Exemplary embodiments of the invention are depicted in the drawings and explained in greater detail in the following description, where the same reference numerals refer to the same or similar or functionally identical parts.

BRIEF DESCRIPTION OF THE DRAWINGS

In the drawings, schematically in each.

DETAILED DESCRIPTION OF THE PRESENT INVENTION

Figure 1:
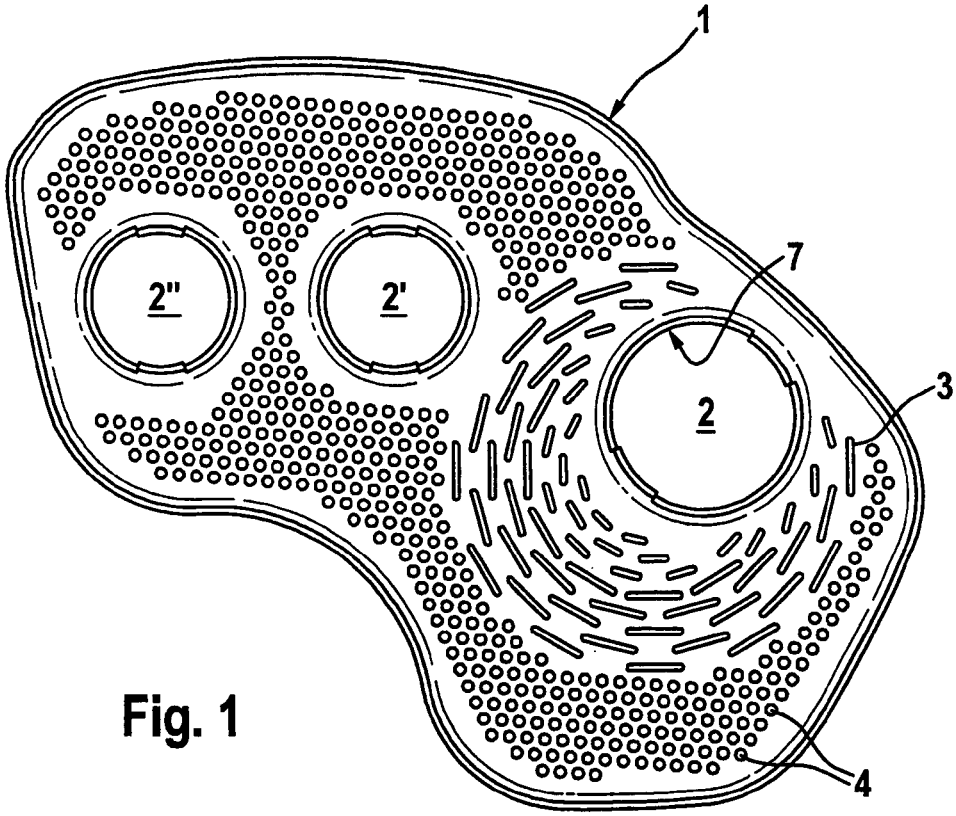
FIG. 1 shows a sheet-metal-type part having the inventive slots passing through it.

According to FIG. 1, a sheet-metal-type part 1 has at least one through-opening 2, here a total of three through-openings 2, 2', 2", whereby a tubular part (not shown here), in particular an exhaust pipe, can be passed through the through-opening 2. Accordingly, the sheet-metal-type part 1 may be designed as a muffler bottom, for example, and may be part of a muffler (not otherwise shown here) of an exhaust system for an internal combustion engine, for example in a motor vehicle. As FIG. 1 also shows, the sheet-metal-type part 1 has a plurality of slots 3 passing through the sheet-metal-type part 1 in an area adjacent to the through-opening 2, these slots running essentially in the circumferential direction of the through-opening 2 or tangentially thereto. The slots 3 may have a curved or straight profile. In addition to the slots 3, the sheet-metal-type part may also have other openings 4 passing through the sheet-metal-type part 1 and arranged in an offset grid pattern according to FIG. 1. However, the openings 4 are shown here merely as an example, so that sheet-metal-type parts 1, which do not have any additional openings 4 according to FIG. 2, should also be included in the invention.

At the longitudinal end of the slots 3, they may have a rounded area 5 which enlarges the slot width (see FIG. 2) and which produces an improved force flow within the sheet-metal-type part 1. Instead of the rounded end 5, the longitudinal end sections of the slots 3 may also be curved in a semicircular shape, which has the same effect. The rounded ends 5 and/or the curved end sections are preferably arranged concave to one another and protrude radially outward away from the respective slot 3.

Figure 2:
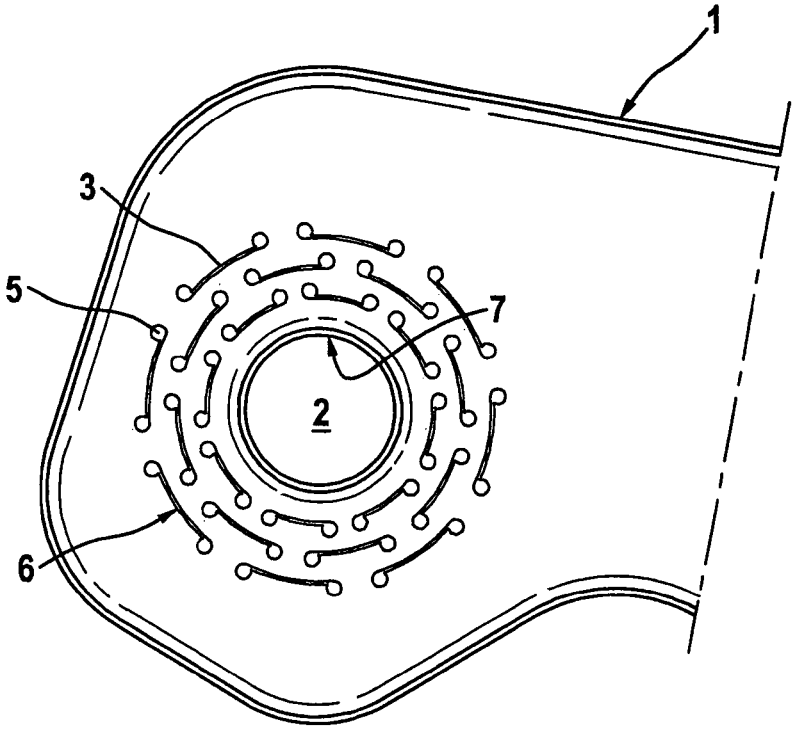
FIG. 2 shows a diagram like that in FIG. 1 but in a different embodiment.

The slots 3 are arranged along a plurality of circles 6 spaced a radial distance apart from another, these circles may not have a common midpoint as shown in FIG. 1 or may be arranged concentrically with one another as shown in FIG. 2. Regardless of the arrangement of the circles 6 in relation to one another, the slots 3 are preferably arranged in a type of offset arrangement to one another along the circles 6 spaced a radial distance apart from one another. Such an offset arrangement is known from the field of masonry, for example, and has the effect that joints between the individual slots 3 do not run continuously in any layer (here: circles 6).

In the installed state, the tubular part (not shown here) passes at least through the through-opening 2 and is fixedly connected to the sheet-metal-type part 1 in the area of the through-opening 2, e.g., by welding or soldering. During operation, there may be heating of the tubular part so that it expands in the circumferential direction. Such an expansion results in forces acting in the circumferential direction on an edge 7 of the through-opening 2, which in the worst case would lead to cracking of the edge 7. To prevent such cracking, the slots 3 are provided in the area adjacent to the through-opening 2. The slots 3 then cause a deflection of the force flow so that the path to the introduction of force is lengthened, preferably so that the sheet-metal-type part 1 can absorb the force which is introduced, e.g., due to the thermal expansion, in the elastic range. The arrangement of the slots 3 in the manner of an offset arrangement along the circle 6 spaced a distance apart from one another radially as described above results in a forced meandering profile of the force flow between the slots 3 and thus lengthens the force introduction pathway in a particularly advantageous manner. The arrangement of slots 3 along the circle 6 spaced a radial distance apart is to be understood as merely an example so that, for example, an arrangement of the slots 3 along rays curving in the circumferential direction is also conceivable.

As also shown in FIGS. 1 and 2, the slots 3 may have different lengths and may be adapted especially well to the expected input of force. It is also conceivable that the slots 3 may be arranged only on a limited circumferential segment around the through-opening 2, as shown in FIG. 1, for example, or may be arranged around the through-opening 2 for the full circumference, as shown in FIG. 2.

In general, the sheet-metal-type part 1 may be designed as a muffler bottom as described above and may therefore form a part of a muffler, e.g., for an exhaust system of a motor vehicle. Such a muffler bottom has the function of a partition, for example, separating two chambers in the muffler from one another. One of the chambers may be, for example, an absorption chamber that is filled with a sound-absorbing material or an absorbent material. The sheet-metal-type part 1 in this embodiment is attached to a housing of the muffler (not shown), in particular by welding. Essentially the sheet-metal-type part 1 here may be made of a plastic or a metal, in particular sheet metal. The term "sheet metal type" as used here should be understood to mean only that in a Cartesian coordinate system, the part 1 has a much smaller thickness than its extent in the longitudinal and/or width directions. In general, the sheet-metal-type part 1 may essentially have any desired three-dimensional profile and need not extend in one plane.

The invention proposes that in the case of a sheet-metal-type part 1 having a through-opening 2 for a tubular part slots 3 are to be provided, passing through the sheet-metal-type part 1 in the area around the through-opening 2 and/or in an area adjacent thereto, these slots being designed and arranged in such a way that a force introduced through the tubular part in particular due to thermal expansion thereof can be absorbed in the elastic range of the sheet-metal-type part 1. To this end, the slots 3 are arranged to run essentially in the circumferential direction or tangentially to the through-opening 2.

The invention claimed is:

1. A sheet-metal-type muffler bottom, having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein said at least one slot has at least one rounded end that enlarges in width on a longitudinal end, and wherein the at least one rounded end is arranged so it is concave to a second rounded end of the at least one slot and the at least one and the second rounded ends point radially outward from the at least one slot.

2. The sheet-metal-type muffler bottom according to claim 1, wherein said at least one slot comprises a plurality of slots, at least two of said plurality of slots being of different lengths.

3. The sheet-metal-type muffler bottom according to claim 1, wherein the at least one slot comprises a plurality of slots, and said plurality of slots arranged around the through-opening on a limited segment of the circumference.

4. The sheet-metal-type muffler bottom according to claim 1, wherein a tubular part is fixedly connected to the sheet-metal-type muffler bottom in the area of said through-opening.

5. A sheet-metal-type muffler bottom, having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein a first and a second end section of said at least one slot on the longitudinal end are curved in a semicircular shape, and wherein the curved first and second end sections are arranged so they are concave to one another and point radially outward from the at least one slot.

6. The sheet-metal-type muffler bottom according to claim 5, wherein said at least one slot comprises a plurality of slots, at least two of said plurality of slots being of different lengths.

7. The sheet-metal-type muffler bottom according to claim 5, wherein the at least one slot comprises a plurality of slots, and said plurality of slots arranged around the through-opening on a limited segment of the circumference.

8. The sheet-metal-type muffler bottom according to claim 5, wherein a tubular part is fixedly connected to the sheet-metal-type muffler bottom in the area of said through-opening.

9. A sheet-metal-type muffler bottom, having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein the at least one slot comprises a plurality of slots arranged along a plurality of circles spaced a distance apart from one another radially, and wherein the plurality of slots has a curved profile.

10. The sheet-metal-type muffler bottom according to claim 9, wherein the slots are arranged in a type of offset arrangement along the circles spaced a distance apart from one another radially.

11. The sheet-metal-type muffler bottom according to claim 10, wherein the circles come in contact at a point.

12. A muffler for an internal combustion engine having a sheet-metal-type muffler bottom having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein said at least one slot has at least one rounded end that enlarges in width on a longitudinal end, and wherein the at least one rounded end is arranged so it is concave to a second rounded end of the at least one slot and the at least one and the second rounded ends point radially outward from the at least one slot, and a tubular pad which in the installed state passes through the sheet-metal-type muffler bottom in said through-opening and is connected to the sheet-metal-type muffler bottom at said through-opening.

13. A sheet-metal-type muffler bottom having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein the at least one slot comprises a plurality of slots arranged along a plurality of circles spaced a distance apart from one another radially, and wherein the plurality of slots has a straight profile.

14. The sheet-metal-type muffler bottom according to claim 13, wherein the slots are arranged in a type of offset arrangement along the circles spaced a distance apart from one another radially.

15. The sheet-metal-type muffler bottom according to claim 14, wherein the circles come in contact at a point.

16. A muffler for an internal combustion engine having a sheet-metal-type muffler bottom having at least one through-opening for an exhaust pipe, wherein the sheet-metal-type muffler bottom has at least one slot passing through the sheet-metal-type muffler bottom in an area adjacent to the through-opening, said at least one slot running essentially in the circumferential direction of the through-opening or tangentially to the through-opening, wherein a first and a second end section of said at least one slot on the longitudinal end are curved in a semicircular shape, and wherein the curved first and second end sections of the at least one slot are arranged so they are concave to one another and point radially outward from the at least one slot; and a tubular part which in the installed state passes through the sheet-metal-type muffler bottom in said through-opening and is connected to the sheet-metal-type muffler bottom at said through-opening.

* * * * *

UNITED STATES PATENT AND TRADEMARK OFFICE

CERTIFICATE OF CORRECTION

PATENT NO. : 7,543,682 B2
APPLICATION NO. : 11/805431
DATED : June 9, 2009
INVENTOR(S) : Robert Hanitzsch et al.

It is certified that error appears in the above-identified patent and that said Letters Patent is hereby corrected as shown below:

Column 5, Claim 12, line 25, change “pad” to -- part --.

Signed and Sealed this

Fourth Day of August, 2009

JOHN DOLL
*Acting Director of the United States Patent and Trademark Office*